US007232353B1

(12) United States Patent
Gauthier

(10) Patent No.: US 7,232,353 B1
(45) Date of Patent: Jun. 19, 2007

(54) RETRIEVABLE PNEUMATIC BUOY SYSTEM FOR SUBMARINE USE

(75) Inventor: Benoit G. Gauthier, Little Compton, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 179 days.

(21) Appl. No.: 11/108,051

(22) Filed: Apr. 18, 2005

(51) Int. Cl.
*B63B 22/08* (2006.01)
*B63G 8/28* (2006.01)

(52) U.S. Cl. ..... 441/7; 114/318

(58) Field of Classification Search ..... None
See application file for complete search history.

(56) References Cited

U.S. PATENT DOCUMENTS 1,295,805 A 2/1919 Shafer
1,636,447 A 7/1927 Standish
1,748,874 A * 2/1930 Fentress ..... 114/328
2,014,742 A * 9/1935 Mastorakis ..... 114/328
3,961,589 A 6/1976 Lombardi
3,972,047 A 7/1976 Lombardi
4,493,664 A 1/1985 Dale
4,717,092 A 1/1988 Cameron
5,348,501 A 9/1994 Brown
5,676,576 A 10/1997 Shonting et al.
6,701,819 B1 * 3/2004 Williams et al. ..... 89/1.81

* cited by examiner

*Primary Examiner*—Jesús D. Sotelo
(74) *Attorney, Agent, or Firm*—James M. Kasischke; Michael P. Stanley; Jean-Paul A. Nasser

(57) ABSTRACT

An inflatable buoy launch and retrieval system comprises an underwater platform, a launch/retrieval tube within the underwater platform, and a mechanism for ejecting and retrieving an inflatable buoy from the launch/retrieval tube. The ejection mechanism comprises a reel within the tube for unwinding a length of a tether attached to the buoy and a mechanism for introducing a high pressure gas into the tube.

13 Claims, 2 Drawing Sheets

RETRIEVABLE PNEUMATIC BUOY SYSTEM FOR SUBMARINE USE

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION

1. Field of the Invention

The present invention relates to a system and a method for deploying and recovering inflatable buoys from an underwater platform.

2. Description of the Prior Art

Existing inflatable buoy systems that carry antennae for submarine radio frequency communication are single-use devices. At the end of the transmission cycle, the buoy is severed from the underwater platform, and a relief valve is opened that deflates the buoy and allows it to sink after being collapsed by wave action. Disadvantages to the present buoy system include the expense of jettisoning a buoy for each launch, the long collapse time for the buoy, and the increased possibility of threat detection.

SUMMARY OF THE INVENTION

It is a principal object of the present invention to provide a system for launching and retrieving an inflatable buoy from an underwater platform.

It is a further object of the present invention to provide a method for launching and retrieving inflatable buoys from an underwater platform.

The foregoing objects are attained by the present invention.

In accordance with the present invention, an inflatable buoy launch and retrieval system comprises an underwater platform, a launch/retrieval tube within the underwater platform, and means for ejecting an inflatable buoy from the launch/retrieval tube. The ejecting means comprises a reel within the tube for unwinding a length of a tether attached to the buoy and means for introducing a high pressure gas into the tube.

Further, in accordance with the present invention, a method for launching and retrieving an inflatable buoy from an underwater platform comprises the steps of providing a launch tube within an underwater platform, the launch tube having an orifice and containing an inflatable buoy in a deflated state to be deployed and a length of tether wound on a storage reel within the launch tube, opening a watertight valve adjacent the orifice of the launch tube, and unwinding a length of tether from the storage reel and ejecting gas under pressure into the launch tube to deploy the inflatable buoy from the underwater platform.

Other details of the retrievable pneumatic buoy system for submarine use, as well as other advantages and objects attendant thereto, are set forth in the following detailed description and the accompanying drawings, wherein like reference numerals depict like elements.

DETAILED DESCRIPTION OF THE PREFERRED EMBODIMENT(S)

Figure 1:
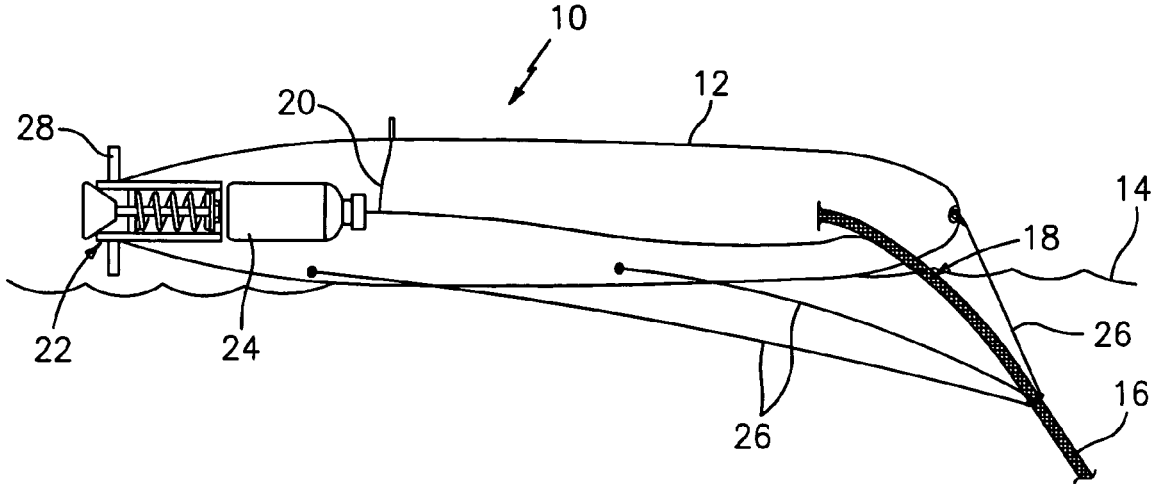
FIG. 1 is a schematic representation of an inflatable buoy which may be deployed from and retrieved by an underwater platform.

Referring now to the drawings, FIG. 1 shows a buoy 10 consisting of a gas tight envelope 12 which is deployed to a floating position on the surface 14 of a body of water. The envelope 12 may be shaped in such a way that is advantageous for the desired antenna topology and hydrodynamic loading. The buoy 10 is deployed from and connected to a submerged vehicle via a tether 16 that consists of a communication conduit 18 connecting the host vehicle to one or more antennae 20 housed within the envelope 12. The antenna 20 may be constructed of a number of materials, including folded flex-circuit, plated surfaces, or discrete elements. The envelope 12 is pressurized pneumatically and that pressure is limited to a maximum level over ambient pressure by a pressure relief valve 22. The envelope 12 is pressurized either by an internal bottle 24 of gas that is fired electrically, or by a conduit in the tether 16. The pressure bottle 24 is standard practice in present submarine launched buoys. To deploy the buoy 10 multiple times from any platform, the gas should be provided from the conduit. The tether 16 may be connected to the envelope 12 at multiple points by a tow bridle 26 to provide better dynamic performance at towing speeds. The pressure relief valve 22 is surrounded with a compliant collar 28 that is of the correct diameter to fit snugly within the bore to the launch and recovery system 30 shown in FIG. 2.

Figure 2:
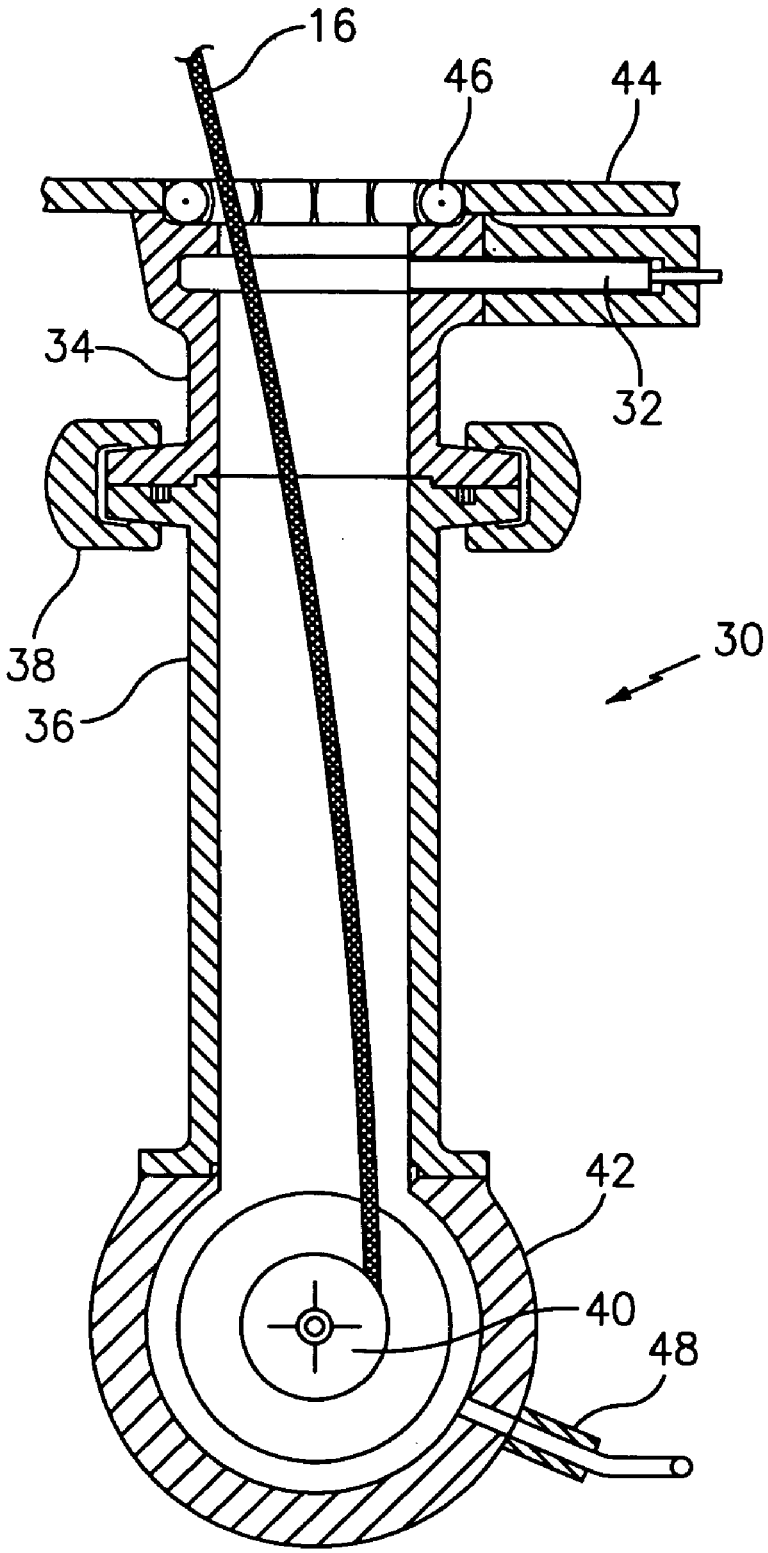
FIG. 2 is a sectional view of an inflatable launch and retrieval system in accordance with the present invention in a launch mode.

In FIG. 2, one sees the tether 16 deployed from the launch and recovery system 30. The system 30 consists of a watertight muzzle valve 32, and through hull fitting 34 positioned at a pathway 35 of the submarine vehicle and, connected to a main storage launch and retrieval tube 36 by a quick disconnect clamp 38. The muzzle valve 32 may be a slide valve or ball valve and is standard practice on existing signal ejector tubes. The tether 16 connects to a stowage reel 40 housed within the pressure vessel 42 connected to the breech of the tube 36. The entirety of the launch and recovery system 30 may be designed so that it can operate safely at the maximum operating depth of the submarine vehicle. The system 30 is mounted via the through hull fitting 34 to the vehicle pressure hull 44. The orifice of the launch tube 36 or through hull fitting 34 is either rounded or its perimeter circumferentially fitted with a plurality of roller fairleads 46 to prevent snagging or fraying the-buoy 10 or tether 16 during launch, use, and retrieval.

Figure 3:
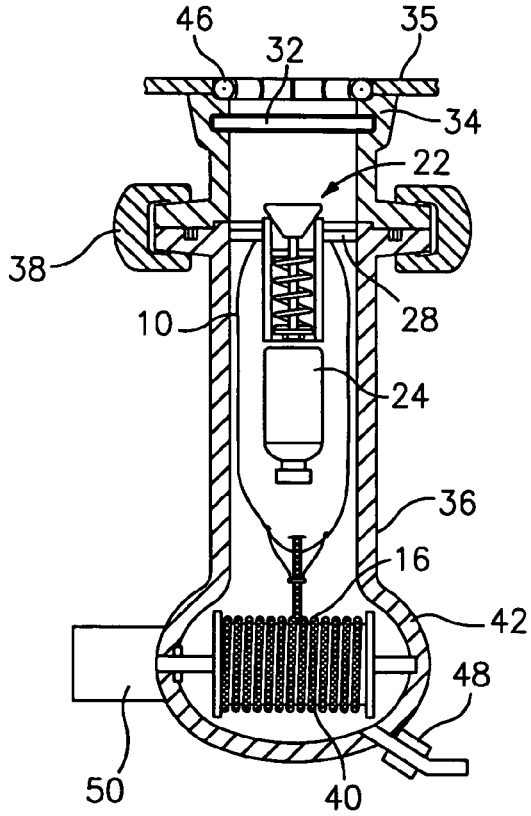
FIG. 3 is a sectional view of the inflatable launch and retrieval system of FIG. 2 with the inflatable buoy having been retrieved.

FIG. 3 shows the buoy 10 loaded in the tube 36. The compliant collar 28 and pressure relief valve 22 are at the muzzle end, just below the parting line of the tube 36 and through hull fitting 34. The lower pressure vessel 42 is fitted with a high pressure supply line and valve 48 which is used to eject the buoy 10 from the launch tube 36, after having unwound a sufficient length of tether 16 from the reel 40 using the tether winch motor 50. The motor 50 may be external as shown or integrated into the hub of the winch reel. Upon exiting the tube 36, the buoy 10 is inflated and begins to rise to the surface 14. If the buoy 10 is provided an excess of inflation gas, the relief valve 22 opens to maintain safe working pressure. At the end of the communications interval, the buoy 10 is winched back to the submerged vehicle or platform. As the depth pressure increases on the envelope 12 during the decent to the platform, the pressure relief valve 22 opens to vent the internal gas. When the buoy 10 reaches the tube fairlead 46, the remaining gas is expelled by the fairlead 46 squeezing the envelope 12 as it is retrieved fully into the tube 36. Once the buoy 10 is retrieved, the muzzle valve 32 is shut. If the system is being operated on a submarine, then at this point the buoy launch tube 36 may be separated from the through hull fitting 34 for service and replenishment of the pressure bottle 24 or the buoy 10 may be exchanged for a different type.

The ability to retrieve the buoy 10 makes submerged RF communication viable for smaller vehicles and unmanned underwater vehicles that need to perform multiple communications or GPS updates, and that cannot carry or reload an inventory of buoys. Moreover the use of communications or GPS antennae on buoys would allow these UUVs to perform their RF functions in stride with their other submerged mission responsibilities, obviating the need to surface.

It is apparent that there has been provided in accordance with the present invention a retrievable pneumatic buoy system for submarine use which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A buoy launch and retrieval system comprising:

a launch/retrieval tube capable of attachment to an interior of an underwater platform;

means for ejecting a buoy from said launch/retrieval tube, said ejecting means comprising a reel within said launch/retrieval tube for unwinding a length of a tether attached to the buoy and means for introducing a high pressure gas into said tube for ejection of the buoy through a pathway of a hull of the underwater platform;

a through hull fitting attachable to the pathway and attached to said launch/retrieval tube with a watertight valve adjacent one end of said through hull fitting; said watertight valve operable to an open position to allow ejection of the buoy; and a quick disconnect clamp for joining said through hull fitting to said launch/retrieval tube.

2. A buoy launch and retrieval system comprising:

a launch/retrieval tube capable of attachment to an interior of an underwater platform;

means for ejecting a buoy from said launch/retrieval tube, said ejecting means comprising a reel within said launch/retrieval tube for unwinding a length of a tether attached to the buoy and means for introducing a high pressure gas into said tube for ejection of the buoy through a pathway of a hull of the underwater platform; and said launch/retrieval tube having a roller fairlead at an orifice of said launch/retrieval tube for preventing snagging and fraying of the buoy and the tether.

3. A buoy launch and retrieval system comprising:

a launch/retrieval tube capable of attachment to an interior of an underwater platform;

means for ejecting a buoy from said launch/retrieval tube, said ejecting means comprising a reel within said launch/retrieval tube for unwinding a length of a tether attached to the buoy and means for introducing a high pressure gas into said tube for ejection of the buoy through a pathway of a hull of the underwater platform;

a communication conduit attachable to the buoy and capable of operation with an antenna of the buoy; and a tow bridle for connecting the tether to the buoy at a plurality of points.

4. A buoy launch and retrieval system comprising:

a launch/retrieval tube capable of attachment to an interior of an underwater platform;

means for ejecting a buoy from said launch/retrieval tube, said ejecting means comprising a reel within said launch/retrieval tube for unwinding a length of a tether attached to the buoy and means for introducing a high pressure gas into said tube for ejection of the buoy through a pathway of a hull of the underwater platform;

said buoy including a gas tight envelope and at least one antenna attached to said envelope; and said buoy having a pressure relief valve for controlling gas pressure within said envelope and a compliant collar surrounding said pressure relief valve.

5. The buoy launch and retrieval system according to claim 4, further comprising an internal bottle of gas for inflating said envelope.

6. The buoy launch and retrieval system according to claim 5, further comprising a motor attached to said reel for unwinding and winding said length of said tether.

7. A method for launching and retrieving an inflatable buoy from an underwater platform comprising the steps of:

providing a launch tube within an underwater platform, the launch tube having an orifice and containing an inflatable buoy in a deflated state to be deployed and a length of tether wound on a storage reel within the launch tube;

opening a watertight valve adjacent the orifice of the launch tube;

unwinding a determined length of tether from the storage reel and ejecting gas under pressure into the launch tube to deploy the inflatable buoy from the underwater platform; and inflating the buoy with an inflation gas after the buoy has exited the orifice so that the buoy rises to a water surface.

8. The method according to claim 7, further comprising opening a relief valve in the buoy to expel excess inflation gas.

9. The method according to claim 8, further comprising winching the buoy back after an end of a communication interval and opening the relief valve in the buoy to vent the inflation gas as depth pressure increases.

10. The method according to claim 9, further comprising expelling all remaining inflation gas from the buoy when the buoy reaches the orifice.

11. The method according to claim 10, wherein said expelling step comprises squeezing the buoy with a tube fairlead positioned adjacent the orifice as the buoy is being fully drawn into the tube.

12. The method according to claim 11, further comprising shutting the relief valve after the buoy is fully drawn into the tube.

13. The method according to claim 12, further comprising separating the tube to service the buoy.

* * * * *